US008674850B2

(12) United States Patent
Zimmer et al.

(10) Patent No.: US 8,674,850 B2
(45) Date of Patent: Mar. 18, 2014

(54) SELECTIVE WEATHER NOTIFICATION

(75) Inventors: Nico Zimmer, Kenn (DE); Keyvan Bayram, Frankfurt (DE)

(73) Assignee: The Boeing Company, Chicago, IL (US)

( * ) Notice: Subject to any disclaimer, the term of this patent is extended or adjusted under 35 U.S.C. 154(b) by 25 days.

(21) Appl. No.: 13/249,721

(22) Filed: Sep. 30, 2011

(65) Prior Publication Data

US 2012/0274484 A1 Nov. 1, 2012

Related U.S. Application Data

(63) Continuation-in-part of application No. 12/871,412, filed on Aug. 30, 2010.

(51) Int. Cl.
*G08B 21/00* (2006.01)

(52) U.S. Cl.
USPC ..... 340/945; 340/500

(58) Field of Classification Search
USPC ..... 340/945; 701/14, 32.3, 32.4, 423, 701/428–429
See application file for complete search history.

(56) References Cited

U.S. PATENT DOCUMENTS

| | | | | |
|---|---|---|---|---|
| 4,425,617 | A * | 1/1984 | Sherwood | 710/65 |
| 6,199,008 | B1 | 3/2001 | Aratow et al. | |
| 6,700,482 | B2 * | 3/2004 | Ervers et al. | 340/500 |
| 7,081,834 | B2 * | 7/2006 | Ruokangas et al. | 340/945 |
| 7,813,871 | B2 * | 10/2010 | Small et al. | 701/120 |
| 8,046,165 | B2 | 10/2011 | Sacle et al. | |
| 8,200,378 | B1 | 6/2012 | Chiew et al. | |
| 8,203,465 | B2 * | 6/2012 | Shafaat et al. | 340/971 |
| 8,332,048 | B2 | 12/2012 | Swanson | |
| 8,332,084 | B1 * | 12/2012 | Bailey et al. | 701/10 |
| 2006/0129286 | A1 | 6/2006 | King | |
| 2009/0093953 | A1 * | 4/2009 | Wiesemann et al. | 701/200 |
| 2012/0274484 | A1 | 11/2012 | Zimmer et al. | |

OTHER PUBLICATIONS

Defense Internet NOTAM Service, "NOTAM Retrieval" https://www.notams.jcs.mil/dinsQueryWeb/ [retrieved Jan. 14, 2010], 2 pages.
Hatta, Takashi, "Current activity towards digital AIM in Japan," 5th Digital NOTAM Workshop, EUROCONTROL, 10 pages, Sep. 2009.
Vernaleken, et al., "Considerations on Symbology, Data Requirements, and Operational Concept for Integral NOTAM Visualization on Airport Moving Map Displays," Proceedings of SPIE vol. 6957, Enhanced and Synthetic Vision 2008, 16 pages, Apr. 2008.
Final Office Action in U.S. Appl. No. 12/689,600 dated Jun. 22, 2012.

(Continued)

*Primary Examiner* — Shirley Lu
(74) *Attorney, Agent, or Firm* — Hope Baldauff, LLC

(57) ABSTRACT

Methods, systems, and computer-readable storage media provide for selective weather notifications to be made to the crew of an aircraft according to the level of relevance of the weather information to a selected phase of flight of the aircraft. According to embodiments described herein, weather information is received and parsed into weather components. The weather components and corresponding thresholds are used with the selected phase of flight to determine a relevance code for the weather information according to a set of relevance rules. The relevance rules provide a level of relevance of the weather information to the phase of flight and trigger a type of notification according to that level of relevance.

16 Claims, 11 Drawing Sheets

(56) References Cited

OTHER PUBLICATIONS

Non-Final Office Action in U.S. Appl. No. 12/689,600 dated Jan. 6, 2012.

Non-Final Office Action in U.S. Appl. No. 12/871,412 dated Apr. 4, 2013.

Final Office Action dated Nov. 7, 2013 in U.S. Appl. No. 12/871,412.

* cited by examiner

208

| NOTAM SUBJECT | | 204 | | | | | | | | | | | | | | | |
|---|---|---|---|---|---|---|---|---|---|---|---|---|---|---|---|---|---|
| 307 LIGHTING FACILITIES (L) | | PLN | PRE FLT | ENG STRT | TAXI OUT | T-O | REJ T-O | INIT CLMB | E/R CLMB | CRS | DESC | APPR | GO ARND | LDG | TAXI IN | ENG OFF | POST FLT |
| SUBJECT | LA ... | SLSS | SLSS | LMMM | SMMM | LMMM | MMMM | LMMM | MLLL | MLSS | MMSS | MMSL | MMLL | MMMM | MMMM | MMMM | MMML |
| | LB ... 306 | MMML | MMMM | MMMM | MMMM | MMMM | MMMM | MMMM | MMMM | MMLL | MMLL | MMMM | MMMM | MMMM | MMMM | MMMM | MMMM |
| | LC ... 304 | SLSS | SLSS | LMMM | SMMM | LMMM | LMMM | LMMM | MLLL | MLSS | MMSS | MMSL | MMLL | MMMM | MMMS | MMMM | MMMS |
| | LD ... | MMML | MMMM | MMMM | MMMM | MMMM | MMMM | MMMM | MMMM | MMLL | MMLL | MMMM | MMMM | MMMM | MMMM | MMMM | MMML |
| | LX ... | SLSS | SLSS | LMMM | SMMM | LMMM | LMMM | LMMM | MLLL | MLSS | MMSS | MMSL | MMLL | MMMM | MMMS | MMMM | MMMS |
| 307 AIRSPACE RESTRICTIONS (R) | | PLN | PRE FLT | ENG STRT | TAXI OUT | T-O | REJ T-O | INIT CLMB | E/R CLMB | CRS | DESC | APPR | GO ARND | LDG | TAXI IN | ENG OFF | POST FLT |
| SUBJECT | RA ... | SSSS | SSSS | LMMM | SMMM | LLMM | MMMM | SLMM | MSLL | MSSS | MLSS | MMML | MMLL | MMMM | MMMM | MMMM | MMMS |
| | RD ... | SSSS | SSSS | LMMM | SMMM | LLMM | MMMM | SLMM | MSLL | MSSS | MLSS | MMML | MMLL | MMMM | MMMM | MMMM | MMMS |
| | RM ... | SSSS | SSSS | LMMM | SMMM | LLMM | MMMM | SLMM | MSLL | MSSS | MLSS | MMML | MMLL | MMMM | MMMM | MMMM | MMMS |
| | RO ... | SSSS | SSSS | LMMM | SMMM | LLMM | MMMM | SLMM | MSLL | MSSS | MLSS | MMML | MMLL | MMMM | MMMM | MMMM | MMMM |
| | RP ... | SSSS | SSSS | LMMM | SMMM | LLMM | MMMM | SLMM | MSLL | MSSS | MLSS | MMML | MMLL | MMMM | MMMM | MMMM | MMMS |

302

308

| NOTAM STATUS | | | NOTIFICATION ACTIVATION CODE |
|---|---|---|---|
| STATUS | AD | AVAIL FOR DAYLIGHT OPERATIONS | U |
| | AL | OPERATIVE | U |
| | AS | UNSERVICEABLE | E |
| | HX | CONCENTRATION OF BIRDS | E |
| | LC | CLOSED | E |

310 312

| | |
|---|---|
| E | IS EFFECTIVE |
| U | CHANGES TO M |

314 128

| | | |
|---|---|---|
| S | SIGNIFICANT | 1(AURAL/VISUAL/TEXTUAL) |
| L | LIMITED | 2(VISUAL/TEXTUAL) |
| M | MINOR | 3(TEXTUAL – INFO BOX) |
| N | NONRELEVANT | 4(ONLY IN NOTAM PKG) |

*Fig. 3*

702

| 704 MESSAGE VALIDATION | | EFECTIVE MESSAGE | >30 MIN | >1 HR | >2 HRS | >4HRS | VALIDITY | DATA UPDATING |
|---|---|---|---|---|---|---|---|---|
| 706 WEATHER INFO AIRPORT WEATHER | ATIS | E1 | D | U | U | | 30 MIN | EVERY 30 MIN |
| | METAR (SA) | E2 | E1 | D | U | | 60 MIN | EVERY 30 MIN |
| | TAF (FT) | U | U | E1 | E1 | | FC 9H FT 18H, 30H | FC 3H FT 6H |
| 706 WEATHER INFO AREA WEATHER | SIGMET(WS) | E1 | | | | D | 4H | |
| | AIRMET(WA) | E2 | | | | E1 | 6H | |
| | GAMET(W) | D | | | | U | | |
| 704 TIME-BASED CORRELATION | | EFFECTIVE TIME PERIOD | | | | | | |
| 706 AIRPORT ELEMENTS | TREND | AT | E1 | | | | | |
| | | FM | E1 | | | | | |
| | | TEMPO | D | | | | | |

712 NOTIFICATION ACTIVATION CODE

| | |
|---|---|
| E1 | IS EFFECTIVE |
| E2 | EFFECTIVE IF E1-ASSIGNED INFO NOT AVAIL |
| D | DEGRADES THE RELEVANCE BY ONE LEVEL |
| U | CHANGES TO M |

714 128

| | | |
|---|---|---|
| S | SIGNIFICANT | 1(AURAL/VISUAL/TEXTUAL) |
| L | LIMITED | 2(VISUAL/TEXTUAL) |
| M | MINOR | 3(TEXTUAL – INFO BOX) |
| N | NONRELEVANT | 4(ONLY IN NOTAM PKG) |

*Fig. 7B*

SELECTIVE WEATHER NOTIFICATION

CROSS-REFERENCE TO RELATED APPLICATIONS

This application is a continuation in part of co-pending U.S. patent application Ser. No. 12/871,412, filed on Aug. 30, 2010, entitled "Selective NOTAM Notification," the entire disclosure of which is expressly incorporated by reference in its entirety.

BACKGROUND

Pilots and other aircraft crew members rely on many sources of information to accurately and safely plan and prepare for flights. A significant quantity of this information is relatively unchanging with respect to a particular route and/or aircraft, such as distances between fixed points, aircraft capabilities, and airport/runway configurations. However, one ever-changing factor that is significant to both flight planning and flight operations is the weather. There are numerous sources for weather information, including but not limited to, a meteorological terminal area forecast (METAR), a terminal area forecasts (TAF), an automatic terminal information service (ATIS), significant meteorological information (SIGMET), airman meteorological information (AIRMET), general aviation meteorological information (GAMET), and a pilot report (PIREP).

Weather information from all of these sources and others, including on-board weather radar, is regularly updating and becoming available to pilots. While weather information is very important to the pilots, a large volume of the information is not applicable to the current phase of flight of the aircraft or will likely change before it becomes applicable. The pilot or crew must parse through all of the weather information to manually determine the information that is applicable, and to ascertain the importance of the applicable information. This process is cumbersome and inefficient, which increases the pilot's workload and creates an opportunity for errors to be made as important information may be missed.

It is with respect to these considerations and others that the disclosure made herein is presented.

SUMMARY

It should be appreciated that this Summary is provided to introduce a selection of concepts in a simplified form that are further described below in the Detailed Description. This Summary is not intended to be used to limit the scope of the claimed subject matter.

Methods, systems, and computer-readable storage media described herein provide for the selective notification of relevant weather information according to a target phase of flight. The concepts and technologies disclosed herein allow for various types of notifications of applicable weather information to be made to the pilots depending on the phase of flight that the aircraft is currently in, or any other desired phase of flight, and the determined level of relevance of the weather information. As a result, the pilots are able to much more quickly and efficiently review the weather information that applies to their selected flight phase without having to sort through large volumes of information, much of which has relatively little relevance to the current phase of flight or selected phase of flight.

According to one aspect of the disclosure provided herein, weather information is received. The target or selected phase of flight is determined and used to determine a level of relevance for the weather information. A notification of the weather information is provided according to the level of relevance of the information with respect to the target phase of flight.

According to another aspect, a weather information system includes a weather notification processor, a memory, and a weather notification application executed by the processor. When executed, the weather notification application allows for relevant weather information to be provided to a crew of an aircraft according to a target phase of flight. The weather information is received at the aircraft and the current phase of flight is determined. A set of relevance rules are retrieved and used to determine a relevance for the weather information. The relevance rules include a relevance code for the weather information at each phase of flight. A notification of the weather information is provided according to the determined level of relevance for the current or target phase of flight.

According to yet another aspect, weather information is received and the target phase of flight is determined. A level of relevance is determined for the weather information according to the target phase of flight and to at least one aircraft related criterion. A notification method is determined according to the level of relevance and a notification is provided accordingly.

The features, functions, and advantages that have been discussed can be achieved independently in various embodiments of the present disclosure or may be combined in yet other embodiments, further details of which can be seen with reference to the following description and drawings.

BRIEF DESCRIPTION OF THE DRAWINGS

FIG. 3 is an illustrative table showing an example set of NOTAM relevance rules according to various embodiments presented herein;

FIGS. 7A and 7B are an illustrative table showing an example set of weather relevance rules according to various embodiments presented herein;

DETAILED DESCRIPTION

Figure 1:
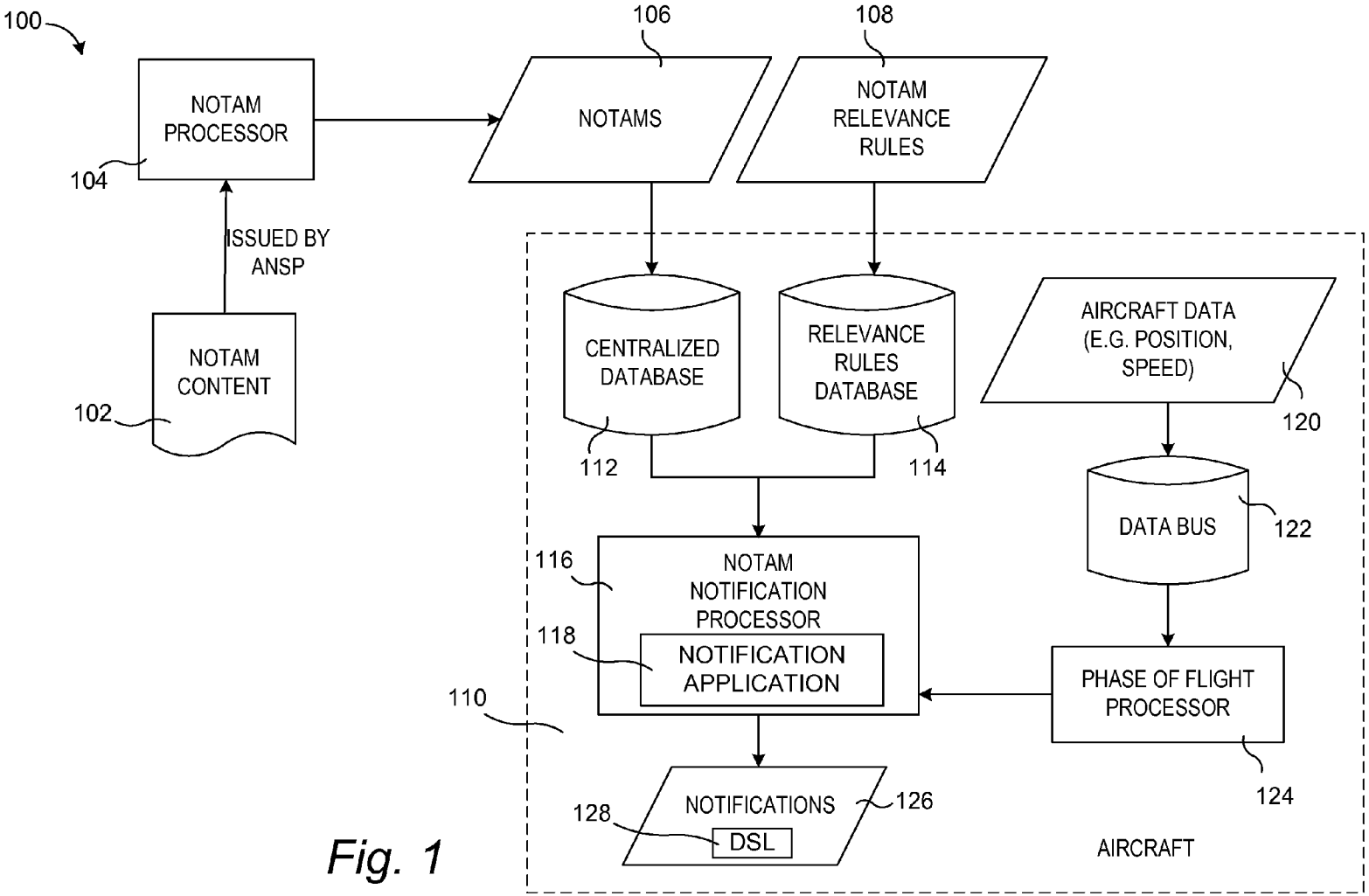
FIG. 1 is a block diagram showing a NOTAM notification system and the flow of NOTAM content through the system to create a notification according to various embodiments presented herein.

The following detailed description is directed to methods, systems, and computer-readable storage media for selecting relevant weather information corresponding to the current or other selected phase of flight of an aircraft and providing appropriate notifications to the crew. As discussed briefly above, parsing through the vast quantity of weather information for any given flight is a task that consumes a significant amount of time and creates a risk that valuable information will be missed during the cumbersome process. Utilizing the concepts and technologies described herein, pilots are provided with various levels or types of notifications corresponding to the relevance of the weather information that applies to a specific phase of flight that is of interest to the pilot.

In the following detailed description, references are made to the accompanying drawings that form a part hereof, and which are shown by way of illustration, specific embodiments, or examples. Referring now to the drawings, in which like numerals represent like elements through the several figures, the selective notification of relevant weather information will be described. Although the present disclosure may be applicable to the selective notification of any type of information that is provided to the pilot or crew of an aircraft, two primary embodiments will be described herein for illustrative purposes. The first embodiment corresponds to the selective notification of NOTAM content and will be described with respect to FIGS. 1-4 and 10. The second embodiment corresponds to selective notification of weather information and will be described with respect to FIGS. 5-10.

Turning now to FIG. 1, FIG. 1 shows a NOTAM notification system 100 according to one embodiment described herein. According to this embodiment, the NOTAM notification system 100 includes a ground-based NOTAM processor 104 that receives NOTAM content 102 from any number of NOTAMs issued by an Air Navigation Service Provider (ANSP). The NOTAM processor 104 processes the NOTAM content 102 into electronic NOTAMs 106 for use by the components of the NOTAM notification system 100 installed within an aircraft 110.

The NOTAMs 106 are uploaded to the aircraft 110 and stored in a centralized database 112 or other data repository for access by a NOTAM notification processor 116. The NOTAM notification processor 116 executes a notification application 118 that is operative to perform the various operations described herein. Specifically, the NOTAM notification processor 116 utilizes the electronic NOTAMs 106 stored within the centralized database 112, in combination with a set of NOTAM relevance rules 108 stored within a relevance rules database 114 or other data repository on the aircraft 110, and with phase of flight information provided by a phase of flight processor 124, to determine which NOTAMs 106 to provide to the crew of the aircraft 110, as well as to select a format in which to provide the notification 126.

The NOTAM relevance rules 108 are a set of rules that establish the relevancy of NOTAMs according to the subject of the various NOTAMs and to the phase of flight of the aircraft 110. The NOTAM relevance rules 108 will be described in greater detail below with respect to FIG. 3. The rules are stored in a relevance rules database 114 or other data repository on the aircraft 110. It should be appreciated that the centralized database 112 and the relevance rules database 114 may be the same database, or may be separate data repositories.

In order to determine the relevance of each NOTAM 106, the notification application 118 utilizes the current phase of flight, or any other phase of flight selected by the pilot or other user, as applicable. The various phases of flight and how this information is used to determine the relevance will be discussed in greater detail below with respect to FIGS. 2 and 3. For the purposes of FIG. 1, the phase of flight processor 124 utilizes any quantity and type of aircraft data 120 received via a data bus 122 to determine the current phase of flight, if the current phase of flight is of immediate interest. For example, the phase of flight processor 124 may utilize a global positioning system (GPS) receiver to determine the precise geographic location of the aircraft 110. With this information, coupled with current aircraft speed information and the corresponding programmed flight route, the current location or current phase of flight of the aircraft 110 can be easily determined, for example, that the aircraft 110 is taxiing out to the runway at the departure airport. Alternatively, according to other embodiments, the pilot, dispatcher, or other requesting party may select the phase of flight that is of interest. Using this selected, or target, phase of flight, the notification application 118 may provide the relevant NOTAMs 106 according to the methods described herein.

If the target phase of flight is the current phase of flight, then any type of aircraft data 120 may be used to determine the current phase of flight, including but not limited to, aircraft position, speed, altitude, climb and/or descent rates, control surface positioning, landing gear positioning, flap settings, engine settings, and/or the time of day. The phase of flight processor 124 receives the applicable aircraft data 120, processes the data to determine the current phase of flight, and provides that information to the notification application. It should be understood that while the phase of flight processor 124 is shown to be a separate component from the NOTAM notification processor 116, these two processors may be a single processor of a flight computer installed in the aircraft 110.

After determining the relevance of each NOTAM 106 to the current or other target phase of flight, the notification application 118 determines how the crew of the aircraft 110 should be notified and provides the corresponding notifications 126. As will be discussed in further detail below, the notifications 126 vary according to the relevance of the NOTAM 106 to the crew at the target phase of flight. The level of relevance of each NOTAM 106 triggers a display and signaling level (DSL) 128 that instructs the notification application 118 as to the method of notification to be used when providing the NOTAM 106 to the pilot. For example, if the notification application 118 determines that a NOTAM 106 has a "Significant" relevance to the crew during the target phase of flight, then the corresponding DSL 128 would be "1", which indicates that the notification 126 be made to the pilot in the form of an aural, visual, and textual notification.

Figure 2:
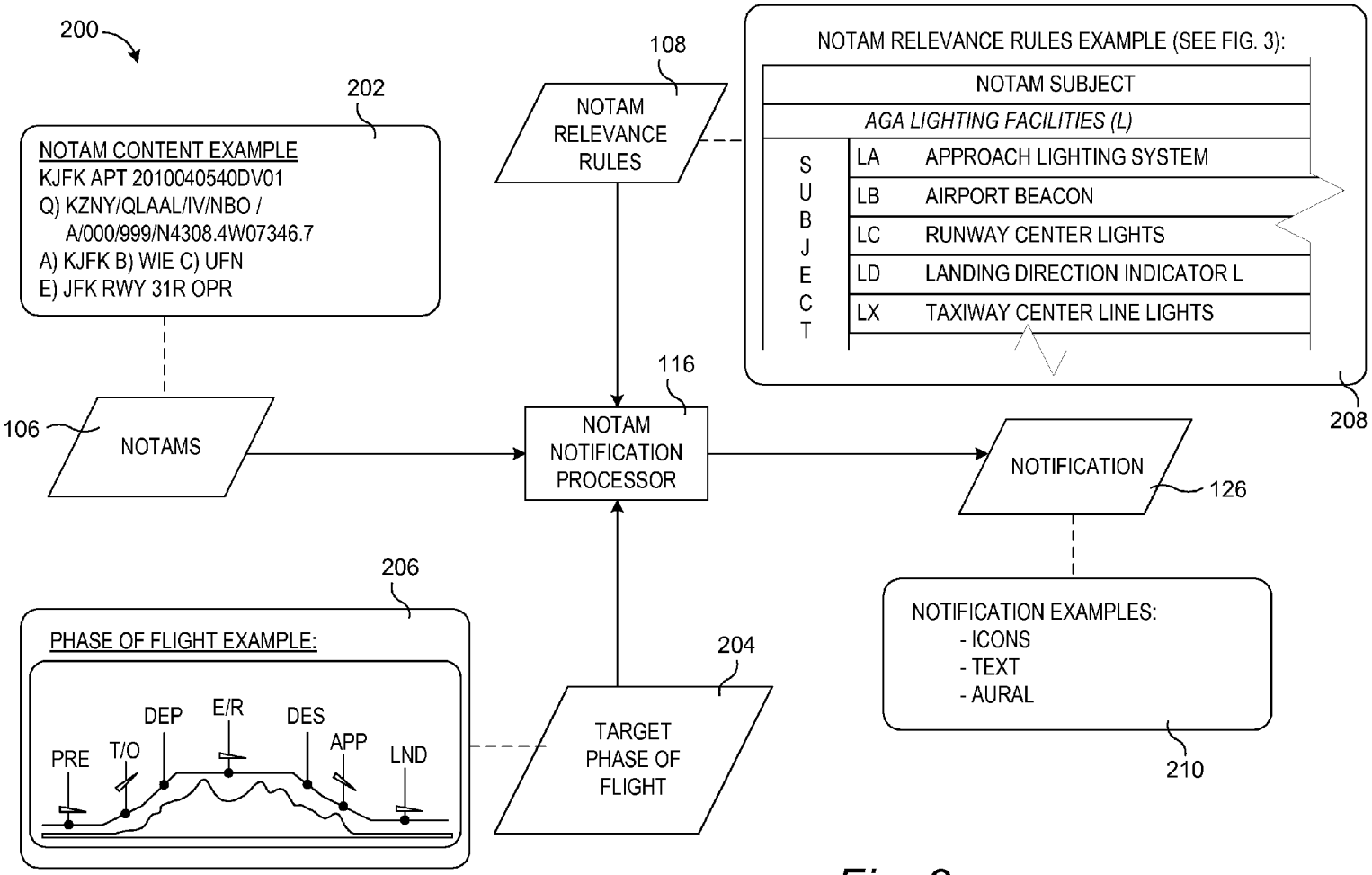
FIG. 2 is a data flow diagram illustrating the data input and output to and from a NOTAM notification processor of an aircraft according to various embodiments presented herein.

Turning to FIG. 2, the data that is utilized by the NOTAM notification processor 116 to create the appropriate notification 126 according to one embodiment will be discussed in further detail. The NOTAM notification system data flow 200 depicts various examples of the data that is received by the NOTAM notification processor 116 and transformed into one or more notifications 126 that are delivered according to the determined level of relevance of the corresponding NOTAMs 106. As seen in FIG. 2, a NOTAM content example 202 shows a NOTAM that includes a Q-code "LAAL." This code is utilized by the NOTAM notification processor 116 to determine the subject of the NOTAM 106, as well as the current status of the NOTAM 106. The first two letters of this code, "LA," represent the subject code of the NOTAM 106, while the remaining two letters, "AL," represent the status code. Every NOTAM 106 includes a subject code and status code that may be used by the NOTAM notification processor 116 to determine the appropriate relevance of the corresponding NOTAMs 106 from the NOTAM relevance rules 108.

The NOTAM relevance rules 108 provide relevance indicators for every phase of flight for each NOTAM subject. A NOTAM relevance rules example 208 is partially shown in FIG. 2 and is shown, and will be described, with greater detail with respect to FIG. 3. As suggested above, FIG. 2 is intended as a general overview to demonstrate the type of information that flows into the NOTAM notification processor 116 and is transformed into applicable notifications 126 for the pilots. The specific NOTAM content example 202, and others, will be explored in detail using the NOTAM relevance rules example 208 below with respect to FIG. 3.

The NOTAM notification processor 116 utilizes the target phase of flight 204 to effectively aid the determination of which NOTAMs 106 are relevant to the aircraft crew. If, for example, a condition exists at an alternate destination airport, it might not be relevant to the pilot while taxiing out to take off from the departure airport. Consequently, according to embodiments described herein, if the target phase of flight 204 is the phase of flight that the aircraft 110 is currently in, the NOTAM notification processor would assign a lower relevance to a NOTAM 106 containing this information about the alternate destination airport during the taxi and takeoff phases of flight, but would increase the relevance of this NOTAM 106 as the aircraft 110 progressed toward the destination airport.

According to various embodiments, a flight may be broken down into any number of phases for the purposes of providing relevant NOTAMs 106 to the pilots. For example, the phase of flight example 206 shown in FIG. 2 shows seven phases of flight, corresponding to preflight, takeoff, departure, en route, descent, approach, and landing phases of flight. However, as seen in the NOTAM relevant rules example 208 shown in FIG. 3, sixteen phases of flight are represented, including flight planning, pre-flight, engine start, taxi-out, takeoff, rejected takeoff, en route climb, cruise, descent, approach, go-around, landing, taxi-in, engine shutdown, and post-flight phases of flight. It should be appreciated that the greater the number of phases of flight incorporated into the NOTAM relevance rules 108 and detectable by the phase of flight processor 124, the greater the ability of the notification application 118 to provide the most relevant information to the pilots in the most efficient manner. However, more or fewer phases of flight may be utilized without departing from the scope of this disclosure.

After determining the target phase of flight 204, the NOTAM notification processor 116 utilizes this information, along with the subject and status codes from the NOTAMs 106, to determine the relevance of the NOTAM 106 to the target phase of flight. Depending on the determined relevance of the various NOTAMs 106, the NOTAM notification processor 116 will provide corresponding notifications 126. As will become clear from the detailed examples discussed below, these notification examples 210 may include various formats, including but not limited to icons, textual notifications, aural notifications, or the conventional notifications available in a conventional NOTAM package.

Turning now to FIG. 3, an illustrative example 208 of a set of relevance rules 108 will now be described according to one embodiment. The relevance rules example 208 includes a NOTAM subject section 302 that lists all potential NOTAM subjects and the corresponding subject codes 306. The subject codes 306 may be grouped according to subject categories 307. For instance, according to the simplified relevance rules example 208 shown here, there are two subject categories 307 corresponding to "Lighting Facilities" and "Airspace Restrictions." In practice, there may be any number of subject categories 307. Within each subject category 307, there is a list of subject codes 306 pertaining to that category. The subject codes 306 are two letter codes found in every NOTAM 106 and identifiable by the NOTAM notification processor 116, which parses the NOTAMs 106 to extract the subject codes 306.

The subject category 307 sections of the rules may additionally include the textual description of each subject code 306, as shown in FIG. 2, but replaced by ellipsis in FIG. 3 to conserve space for clarity purposes. In a row next to each subject code 306 is a group of relevance codes 304, with one code placed in each column corresponding to a current phase of flight 204. For example, the subject code "LA" represents NOTAMs 106 concerning approach lighting systems and includes the relevance code "SLSS" corresponding to the flight planning phase of flight, the relevance code "SLSS" corresponding to the pre-flight phase of flight, the relevance code "LMMM" corresponding to the engine start phase of flight, and so forth.

The relevance codes 304 may include a multi-letter code, with each letter associated with the relevance of the NOTAM subject code 306 in the context of a particular flight segment along the flight route and/or one or more airports associated with that flight segment. The specific letter used represents the level of relevance. For example, according to the NOTAM relevance rules example 208, each relevance code 304 is a four letter code. The first letter corresponds to the departure airport or any other departure alternate airport, or to the departure segment of flight of the planned flight route.

The second letter corresponds to an en route airport or other airport under Extended Range Twin-Engine Operational Performance Standards (ETOPS) guidelines, or to the en route segment of flight of the planned flight route. The third letter corresponds to the alternate destination airports. The fourth letter corresponds to the destination airport or to the arrival segment of flight of the planned flight route. The letter itself identifies the level of relevance of the associated NOTAM subject. According to one embodiment, the letters may be "S" for "Significant," "L" for "Limited," "M" for "Minor," or "N" for "Non-relevant." It should be appreciated that any number of letters, numbers, or symbols may be used as the relevance codes 304. For example, according to an alternative embodiment, the relevance codes 304 each contain three letters, corresponding to the departure, en route, and arrival flight segments, respectively. Similarly, the letters are not limited to "S," "L," "M," and "N." Rather, any quantity and type of relevance indicators can be used within the relevance codes 304.

As an example that illustrates how the NOTAM notification processor 116 determines the relevance of any given NOTAM 106 using the NOTAM relevance rules 108, assume a NOTAM 106 includes the subject code "LX" and a status code of "AS" corresponding to the taxiway center line lights of a departure airport being unserviceable. The NOTAM notification processor 116 determines the current phase of fight 204 to be the planning phase due to aircraft location and timing. Utilizing the NOTAM relevance rules 108, the NOTAM notification processor 116 determines that the relevance code 304 corresponding to the "LX" subject code 306 and "planning" as the current phase of flight to be "SLSS." Therefore, the relevance of this NOTAM 106 at the departure airport is "Significant."

All available status codes 310 of NOTAMs 106 are listed with descriptions in the NOTAM status section 308 of the NOTAM relevance rules 108 according to one embodiment. As described above with respect to the NOTAM subject section 302, the NOTAM status section 308 may have any number of status categories that group together similar status codes 310. For purposes of clarity, a limited number of status codes 310 are shown, and they share a single category.

According to one embodiment, each status code 310 is assigned a notification activation code 312. The notification activation code 312 instructs the NOTAM notification processor 116 as to whether the applicable relevance indicator of the associated relevance code 304 remains effective or is no longer effective. If effective, the relevance indicator remains the same, but if no longer effective, the relevance indicator is downgraded. According to the embodiment shown in FIG. 3, the notification activation code 312 is an "E" if the NOTAM 106 remains effective and a "U" if no longer effective.

Continuing the example with the subject code 306 of "LX" and status code of "AS," the status code 310 corresponds to a notification activation code 312 of "E" since taxiway center line lights being inoperative is a condition for which the pilot would want to be notified. If a condition has improved so that the subject of the NOTAM 106 is now operative or available, the notification activation code 312 is likely to be "U," which would downgrade the relevance indicator of the associated relevance code 304 from "S" to "M," for example. However, in this example, because the notification activation code 312 is "E," the relevance code 304 remains "SLSS."

As stated above, the level of relevance of each NOTAM 106 triggers a DSL 128 that instructs the notification application 118 as to the method of notification to be used when providing the NOTAM 106 to the pilot. Continuing the example, as shown in the box 314 in the lower right portion of FIG. 3, the notification application 118 determines that the NOTAM 106 has a "Significant" relevance to the crew during the current phase of flight 204, which corresponds to a DSL 128 of "1." The DSL 128 of "1" indicates that the notification 126 be made to the pilot in the form of an aural, visual, and textual notification 126. If the DSL 128 is "2," then only visual and textual notifications 126 are made. A DSL of "3" triggers a textual notification within an information box, and a DSL of "4" results in no additional notification other than the conventional NOTAM package. Various methods of providing notifications 126, such as utilizing icon-based notifications, are disclosed in co-pending U.S. patent application Ser. No. 12/689,600, which is herein incorporated by reference in its entirety.

As another example in which the relevance code 304 is downgraded according to the notification activation code 312, refer again to the NOTAM content example 202 shown in FIG. 2. In this example, the code "LAAL" indicates a NOTAM subject code of "LA." If the aircraft 110 is currently in the descent phase of flight 204 and the target phase of flight 204 is the current phase of flight, the correct relevance code 304 would be "MMSS" since the approach lighting system of the destination alternative airport would have a significant relevance to a descending aircraft. However, the status code 310 is "AL," which corresponds to "operative." Because highlighting an operative lighting system to a pilot is less important than highlighting an inoperative approach lighting system, the notification activation code 312 is "U," which changes the relevance indicator "S" to "M." As seen in box 314, a "Minor" relevance triggers a DSL of "3." As a result, this NOTAM 106 might be placed in an information box in textual form for the pilot's review, without any aural warnings or any other icon or other graphical-based notifications.

It should be noted that the relevance rules example 208 shown in FIG. 3, while more comprehensive than the same depiction in FIG. 2, is only a small portion of a set of NOTAM relevance rules 108 used in practice. In practice, there may be a substantially larger set of NOTAM subjects 302 and corresponding two letter subject codes 306, as well as an expanded NOTAM status section 310 with corresponding two letter subject codes 312. It should also be clear that the relevance rules example 208 shown in FIG. 3 depicts only one illustrative example of a set of NOTAM relevance rules 108. According to various embodiments, any quantity and type of target phase of flight 204 identifiers may be included, and any quantity and type of letters or numbers may be used within the corresponding relevance codes 304, without departing from the scope of this disclosure.

Figure 4:
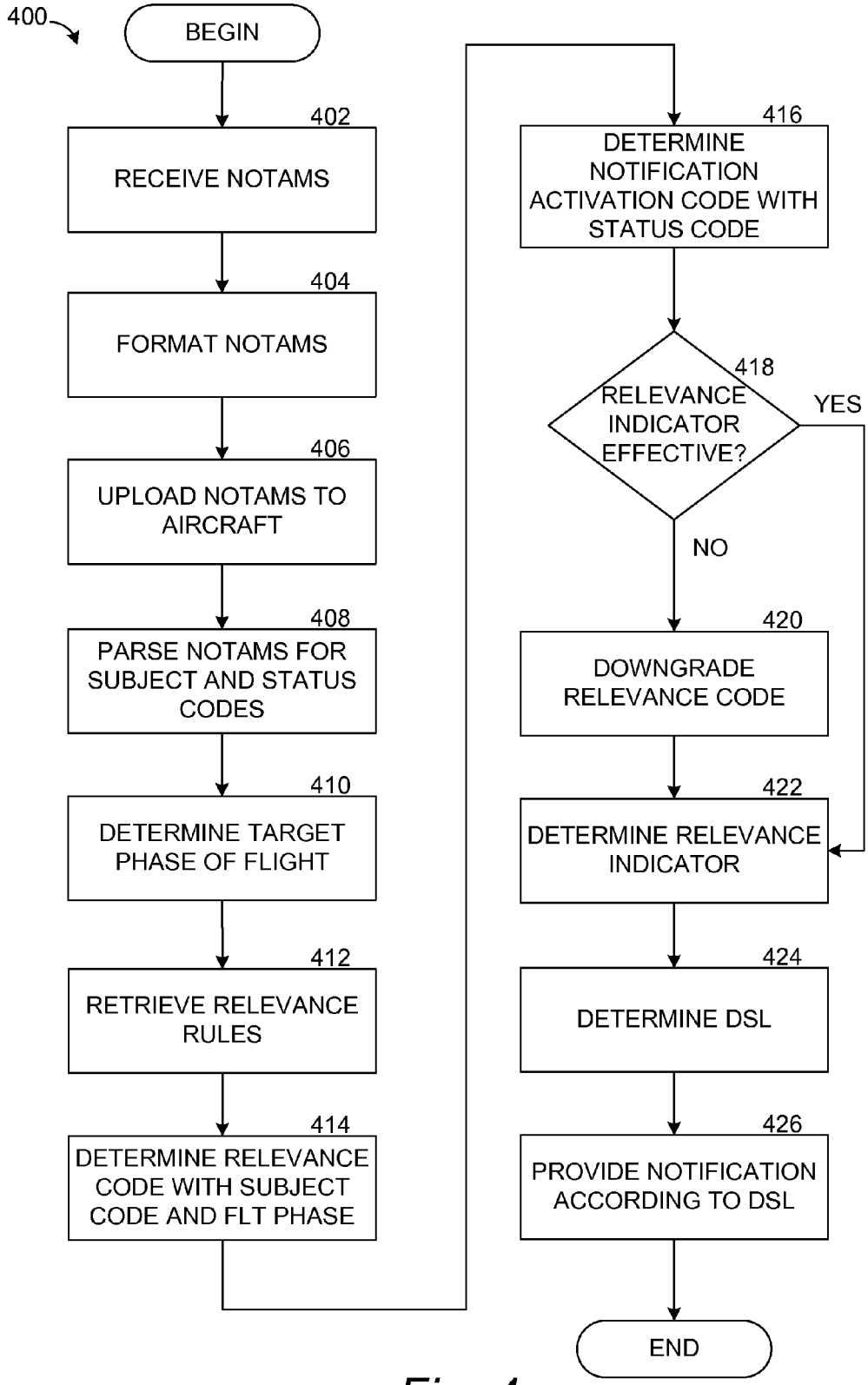
FIG. 4 is a process flow diagram illustrating a method for providing selective NOTAM notifications according to various embodiments presented herein.

Turning now to FIG. 4, an illustrative routine 400 for providing selective notification of NOTAMs according to relevance to the target phase of flight will now be described in detail. It should be appreciated that the logical operations described herein are implemented (1) as a sequence of computer implemented acts or program modules running on a computing system and/or (2) as interconnected machine logic circuits or circuit modules within the computing system. The implementation is a matter of choice dependent on the performance and other requirements of the computing system. Accordingly, the logical operations described herein are referred to variously as operations, structural devices, acts, or modules. These operations, structural devices, acts and modules may be implemented in software, in firmware, in special purpose digital logic, and any combination thereof. It should also be appreciated that more or fewer operations may be performed than shown in the figures and described herein. These operations may also be performed in a different order than those described herein.

The routine 400 begins at operation 402, where a number of NOTAMs are received. The NOTAMs 106 are formatted in an electronic format that can be easily parsed by the notification application 118 for subject and status codes at operation 404. The routine 400 continues to operation 406, where the NOTAMs 106 are uploaded to the aircraft 110. At operation 408, the notification application 118 parses the NOTAMs 106 for NOTAM subject codes 306 and NOTAM status codes 310. From operation 408, the routine 400 continues to operation 410, where the notification application 118 determines the target phase of flight 204. For example, if the relevant NOTAMs 106 for the current phase of flight are requested, the notification application 118 may do this directly using real-time aircraft data 120, or may receive or retrieve this information from the phase of flight processor 124. If the current phase of flight is not the requested target phase of flight 204, then the target phase of flight 204 would simply be the phase of flight selected by the requesting party.

The routine 400 continues from operation 410 to operation 412, where the notification application 118 retrieves the NOTAM relevance rules 108 from the relevance rules database 114. The applicable relevance codes 304 are determined using the NOTAM subject codes 306 and the target phase of flight 204 at operation 414. From operation 414, the routine 400 continues to operation 416, where the notification application 118 determines the notification activation codes 312 that are associated with the NOTAM status codes 310 for all of the received NOTAMs 106.

At operation 418, a determination is made for each NOTAM 106 as to whether or not the applicable relevance indicator is effective. As discussed above, the notification activation code 312 associated with each status code 310 of each NOTAM 106 indicates whether the applicable relevance indicator of the corresponding relevance code 304 is effective. If the relevance indicator is effective, the relevance code 304 for that NOTAM 106 remains the same and the routine 400 proceeds from operation 418 to operation 422 and continues as described below. However, if at operation 418, the notification application 118 determines from the notification activation code 312 for a given NOTAM 106 that the relevance indicator is not effective, then the routine 400 continues to operation 420, where the relevance code 304 is downgraded, such as changing a "Significant" relevance indicator to a "Minor" relevance indicator.

From operation 420, the routine 400 continues to operation 422, where the relevance indicators are determined for each NOTAM 106. As previously discussed, these indicators may correspond to various flight segments and/or airports throughout the planned flight route and provide an indication as the level of relevance that the NOTAM 106 has to that flight segment or airport based on the target phase of flight 204. The applicable relevance indicators trigger a DSL 128 that instructs the notification application 118 as to the method of notification to be used when providing the NOTAM 106 to the pilot. After determining the DSLs 128 at operation 424, the routine 400 continues to operation 426, where the applicable notifications 126 are provided to the crew of the aircraft 110 according to the DSLs 128.

FIGS. 1-4 and the corresponding disclosure above have described various embodiments for selecting relevant NOTAMs corresponding to the current or other selected phase of flight of an aircraft and providing appropriate notifications to the aircraft crew. As will be described below with respect to FIGS. 5-10, various embodiments of the disclosure herein are directed to the selective notification of weather information according to the current or other targeted phase of flight of the aircraft.

Figure 5:
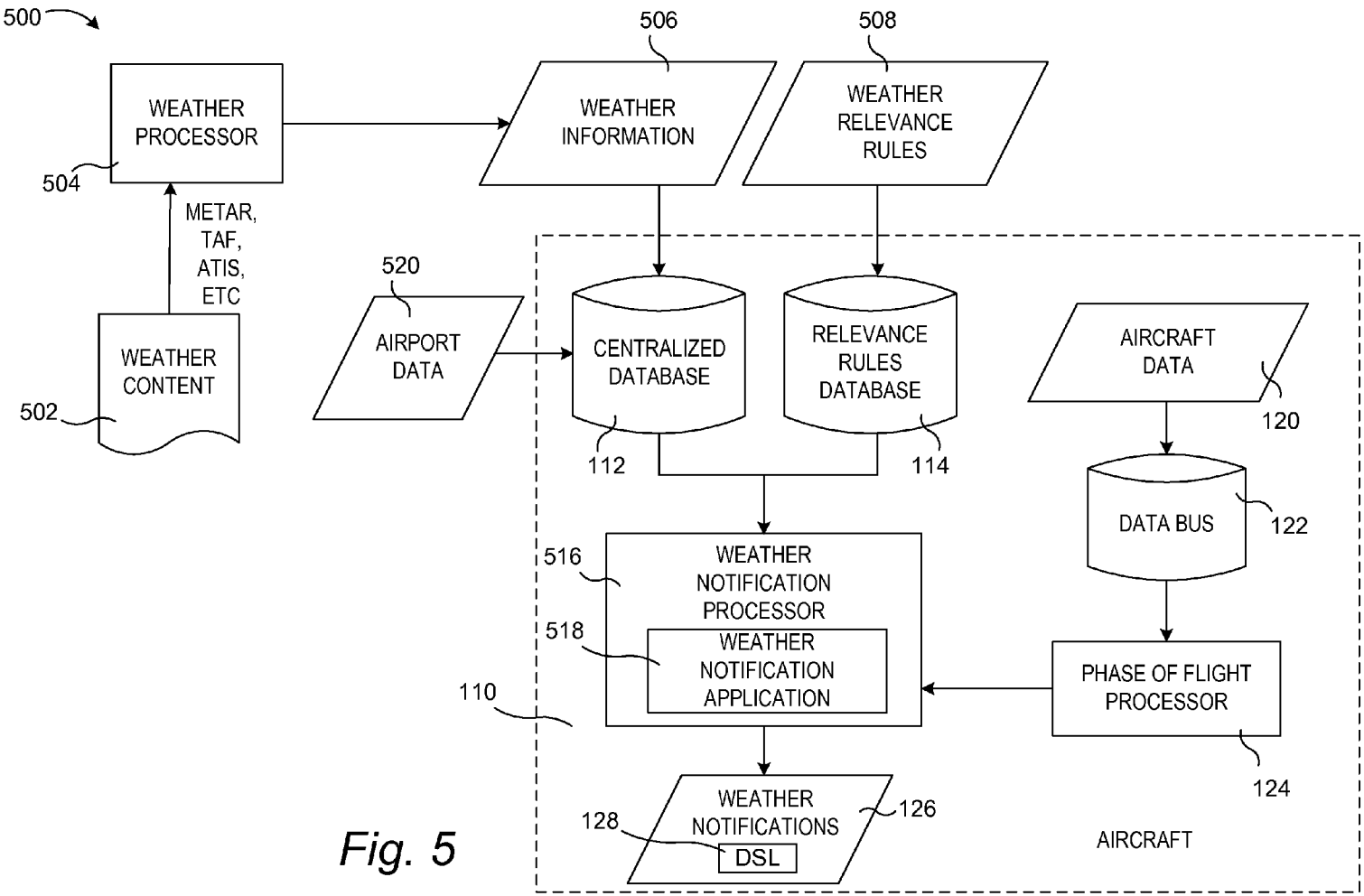
FIG. 5 is a block diagram showing a weather information system and the flow of weather content through the system to create a notification according to various embodiments presented herein.

FIG. 5 shows a weather notification system 500 according to one embodiment described herein. According to this embodiment, the weather notification system 500 includes a ground-based weather processor 504 that receives textual weather content 502 from any number of weather services. There are a number of weather services or sources that provide textual weather content 502 that includes current and/or forecasted weather for use by pilots and other users for flight planning and navigational purposes. Common examples include, but are not limited to, a meteorological terminal area forecast (METAR), a terminal area forecasts (TAF), and weather content from an automatic terminal information service (ATIS).

The weather processor 504 processes the weather content 502 into weather information 506 that is configured in a generic format for use by the components of the weather notification system 500 installed within the aircraft 110. It should be appreciated that according to alternative embodiments, the weather notification system 500 utilizes the weather content 502 in its originating format without converting to a generic format. Consequently, the weather information 506 referred to herein may include formatted weather content 502, unformatted weather content 502, or a combination thereof.

The weather information 506 is uploaded to the aircraft 110 and stored in the centralized database 112 or other data repository for access by a weather notification processor 516. It should be appreciated that the centralized database 112, as well as any other hardware or software components of the weather notification system 500, may be common to the NOTAM notification system 100 described above. Alternatively, any or all of the components of the weather notification system 500 may be separate and independent from the components of the NOTAM notification system 100.

Similar to use of the NOTAM relevance rules 108 by the NOTAM notification system 100 described above, the weather information system 500 utilizes a set of weather relevance rules 508 to establish the relevancy of the weather information 506 as applicable to the current or target phase of flight of the aircraft 110. The weather relevance rules will be described in greater detail below with respect to FIGS. 7A and 7B. The weather relevance rules 508 may be stored in a relevance rules database 114, the centralized database 112, or other data repository on the aircraft 110.

The weather information system 500 includes a weather notification processor 516 that executes a weather notification application 518 operative to execute the various operations described herein. Specifically, the weather notification processor 516 utilizes the weather information 506, applicable airport data 520, aircraft data 120, the applicable set of weather relevance rules 508, and phase of flight information provided by a phase of flight processor 124 to determine what weather information 506 to provide to the crew of the aircraft 110, as well as to select a format in which to provide the notification 126. The phase of flight processor 124 determines the current or target phase of flight information in the same manner as described above with respect to the NOTAM notification system 100. After determining the relevance of the weather information 506 to the current or other target phase of flight, the weather notification application 518 determines how the crew of the aircraft 110 should be notified according to the corresponding display and signaling level (DSL) 128 and provides the corresponding notifications 126.

Figure 6:
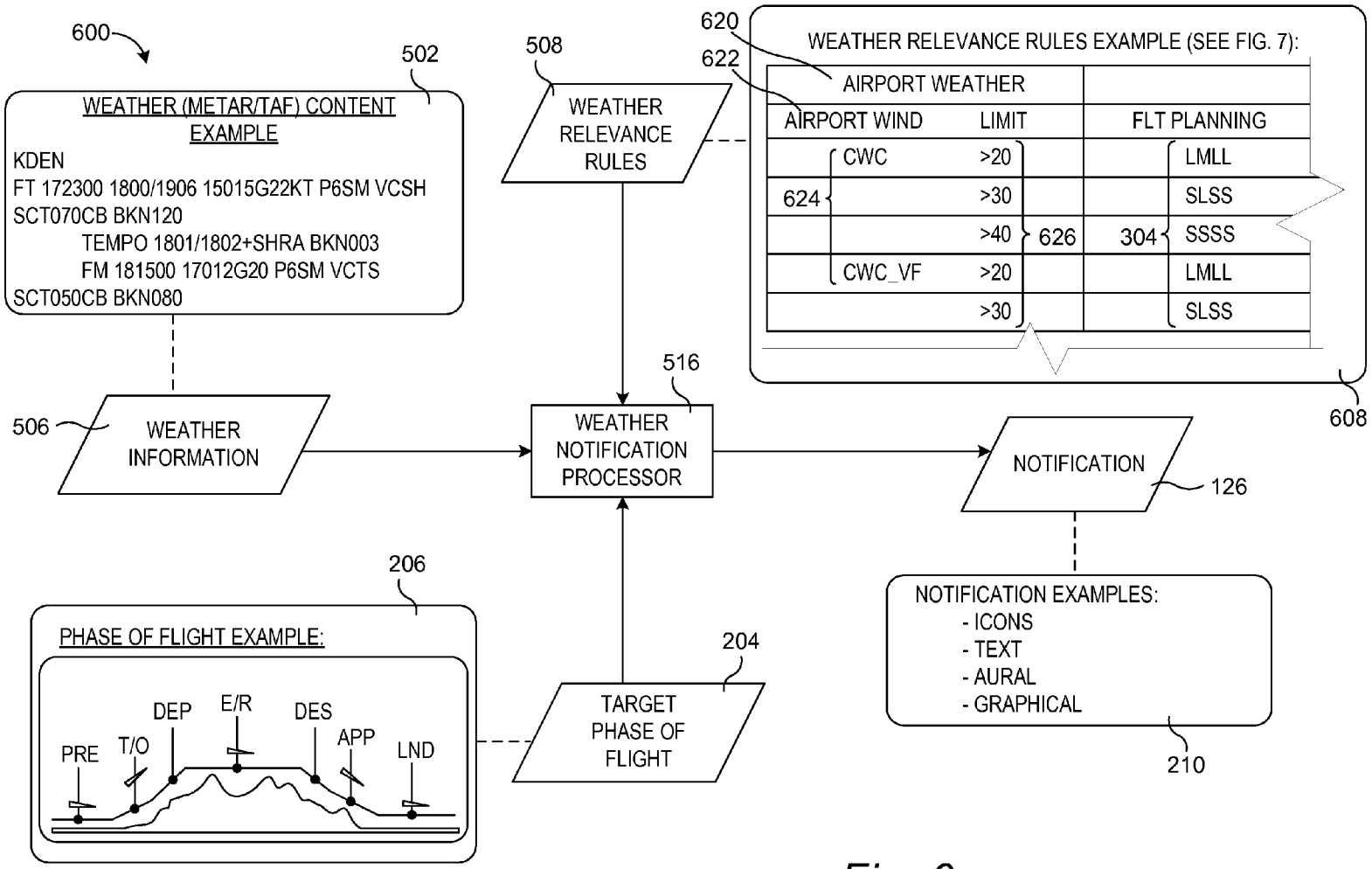
FIG. 6 is a data flow diagram illustrating the data input and output to and from a weather notification processor of an aircraft according to various embodiments presented herein.

Turning to FIG. 6, the data flow to and from the weather notification processor 516 will be discussed in further detail. Comparing this data flow to that of the NOTAM notification system 100 of FIG. 2, it can be seen that the high level process of providing notification with respect to applicable weather information 506 is similar to that of the NOTAM notification process described above. Although the two processes are similar in various features, there are differences that will become apparent in the discussion below.

The weather notification system data flow 600 depicts various examples of the data that is received by the weather notification processor 516 and transformed into one or more notifications 126 that are delivered according to the determined level of relevance of the corresponding weather information 506. As seen in FIG. 6, an example of weather content 502 from a METAR or TAF (or any other textual weather source) is shown. This example shows weather data corresponding to a particular area. The alphanumeric "code" in which the weather data is presented is a standard abbreviated format that is known and understood by all pilots. Among other data, the weather content 502 may indicate the various altitudes associated with particular types of cloud formations, as well as wind direction, speed, and gust approximations at any number of altitudes.

Depending on the source of the weather content 502 or based on parameters within the content itself, the weather content 502 may be applicable to a particular geographic area and for a particular time period. For this reason, the information within the weather content 502 may be more or less applicable, as well as more or less important, to a pilot depending on the current or target location of the aircraft at a given time and the corresponding phase of flight of the aircraft. In addition, the specific source of the weather content 502 may factor into the prioritization of the information. For example, TAFs are typically generated several times a day, while ATIS information is relatively current. As a result, conflicting or varying information from TAF and ATIS reports pertaining to a geographic area around an arrival airport would most likely be most accurate from the ATIS report. Embodiments disclosed herein collect all weather content 502, determines the relevance and priority of the information according to the target phase of flight 204 of the aircraft 110, and provides an appropriate notification 126 to the pilot or aircrew.

As illustrated by the notification example 210, notifications may include any type of notification format, including but not limited to icons, textual notifications, aural notifications, or a combination thereof. In addition, as will be described below with respect to FIG. 8, the notification 126 may include a graphical representation of the applicable weather information 506, dynamically coupled with a textual notification 126 to more efficiently provide the pilot with relevant weather data.

The prioritization of the weather information 506 and relevance determination is made possible through the use of the weather relevance rules 508. Like the NOTAM relevance rules 108 discussed above, the weather relevance rules 508 allows the weather notification processor 516 to select the weather information 506 to present to the pilot according to the target phase of flight 204, as well as the method for providing the notification. However, one difference between this weather embodiment and the NOTAM embodiment described above is that the weather relevance rules 508 provide for further manipulation and data transformation with respect to the weather information in order to determine more specifically how the weather information 506 applies to the particular type of aircraft 110 being flown.

For example, according to one embodiment that will be further described below with respect to FIGS. 7A and 7B, the weather notification processor 516 utilizes algorithms and applicable airport data 520 to further parse wind data from the weather information 506 into crosswind and headwind components according to applicable runway directions for take off and landing flight phases. Utilizing this information, as well as any other applicable criteria such as runway length and aircraft performance criteria and specifications, the weather notification processor 516 may compare the crosswind and headwind components to thresholds that are specific to the aircraft 110 performance criteria in order to determine the level of relevance, priority, and notification methods for presenting the information to the pilot.

Another difference between the weather embodiment described with respect to FIGS. 5-10 and the NOTAM embodiment described above is with respect to the relevance codes 304 of the weather relevance rules 508. While the relevance codes 304 of the NOTAM notification system 100 correspond to the relevance of a NOTAM subject code 306 in the context of a particular flight segment, the relevance codes 304 of the weather information system 500 correspond to predetermined thresholds associated with each applicable component of the weather information 506. A weather relevance rules example 608 is partially shown in FIG. 6 and is shown, and will be described, with greater detail with respect to FIGS. 7A and 7B. As seen in this example of the partial set of weather relevance rules 508, the weather information 506 is organized into weather types 620, weather categories 622 associated with the weather types 620, and any number of weather components 624 of each weather category 622. For each of the weather components 624, there are one or more thresholds 626 or limits that dictate the relevance code 304 associated with various phases of flight.

Figure 7A:
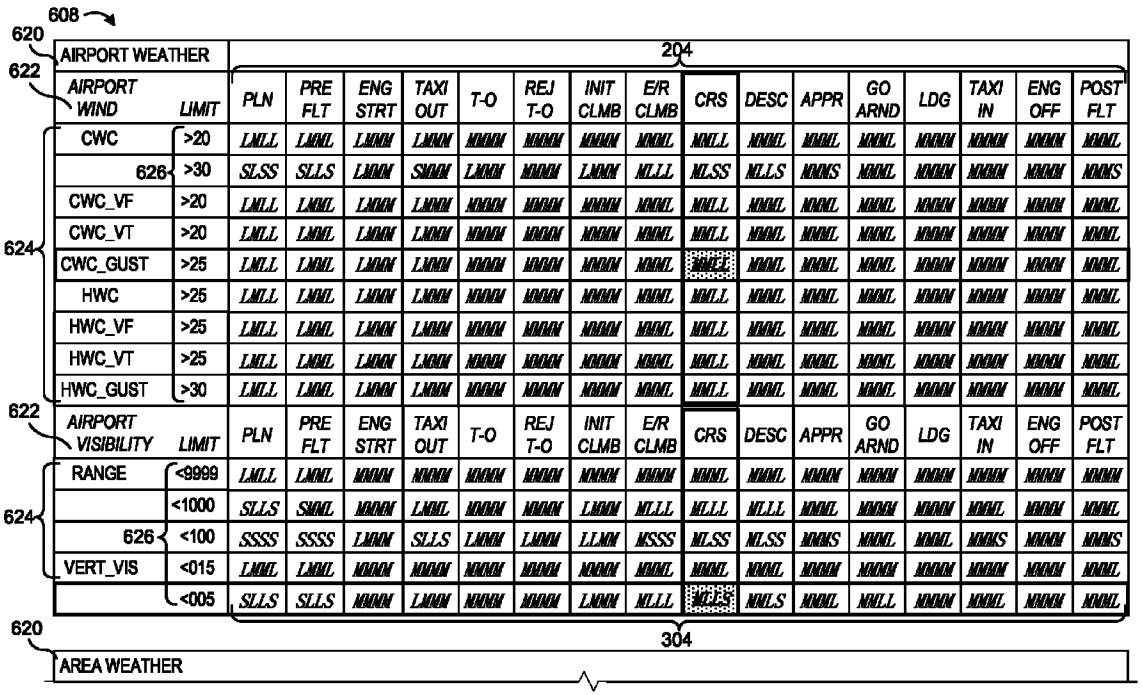

Turning now to FIGS. 7A and 7B, the thresholds 626 and other aspects of the weather relevance rules 508 will be described with respect to the expanded portion of the weather relevance rules example 608 discussed above. A general overview of the organization of the weather relevance rules according to one embodiment will first be given, followed by a detailed explanation with multiple examples to illustrate the concepts of the weather relevance rules 508.

According to the weather relevance rules example 608 shown in FIG. 7A, the weather relevance rules 508 are grouped according to weather types 620, specifically "airport weather" and "area weather." The "airport weather" type 620 corresponds to the relevance codes 304 of all weather components 624 of the received weather information 506 that are associated with weather at or around a departure, enroute alternate, destination alternate or destination airport. In contrast, the "area weather" type 620 may correspond to the relevance codes 304 of all weather components 624 of the weather information 506 that are associated with a particular geographic area pertinent to the flight route. These two weather types 620 may both apply to any particular area and are not exclusive to the other. It should be appreciated that for clarity, weather relevance rules 508 corresponding to the "airport weather" information is provided, and these rules are only a subset of the entire set of rules.

Within each weather type 620, the weather information 506 may be further grouped into weather categories 622, such as "airport wind" and "airport visibility." The weather information 506 is broken down into applicable weather components 624 pertaining to the particular weather category 622. A threshold 626 and corresponding relevance code 304 is assigned to each weather component 624 and used by the weather notification processor 516 to determine when and how to present the information to the pilot.

As stated above, the weather relevance rules example 608 is only a portion of the actual rule set. It should be clear that the scope of the weather relevance rules 508 may be as large or as concise as desired. In effect, any particular element of the weather content 502 provided by a weather service may be transformed into one or more weather components 624 and multiple thresholds applied to arrive at a relevance code 304 pertaining to a particular phase of flight. The weather components 624 shown with respect to the weather relevance rules example 608 that correspond to the airport wind weather category 622 include a crosswind speed component (CWC), varying from and varying to components of the crosswind, crosswind gust speed component (CWC_GUST), headwind speed component (HWC) and corresponding varying from and to components, and headwind gust speed component (HWC_GUST). The "varying from" and "varying to" components represent wind direction "varying from" and "varying to" values retrieved from the weather content 502, such as a METAR. If the wind direction is varying within a directional range, wind components at the lower and upper values of the range may be calculated and corresponding speed values compared to an assigned threshold 626 to arrive at an associated relevance code 304 for notification purposes. Completing the weather relevance rules example 608, the weather components 624 that correspond to the airport visibility weather category 622 include a visibility range component with multiple thresholds 626 and a vertical visibility (i.e., cloud ceiling) component with a couple of example threshold quantities.

To illustrate the potential complexity of the weather relevance rules 508, a non-exhaustive list of possible weather types 620, weather categories 622, and corresponding weather components 624 will now be described according to various embodiments that are only partially shown in FIG. 7A. According to one embodiment, the weather types 620 may include airport weather and area weather. The potential weather categories 622 may include airport wind, airport visibility, airport clouds, airport phenomenon, airport measurements, and miscellaneous weather. The airport wind category 622 may further include various weather components 624 corresponding to crosswind and headwind components, including gust information. The airport visibility category 622 may include weather components 624 corresponding to horizontal and vertical visibility ranges. The airport clouds category 622 may include weather components 624 corresponding to the amount, height, and type of clouds. The airport phenomenon category 622 may include weather components 624 corresponding to precipitation, obscuration and others. The airport measurements category 622 may include weather components 624 corresponding to temperature, dewpoint, and runway visibility ranges. The miscellaneous weather category 622 may include weather components 624 corresponding to any type of weather phenomena or characteristics associated with a particular geographic area, such as ice, turbulence, sand, ash, snow, or hail.

As mentioned above, one difference between the weather information system 500 and the NOTAM notification system 100 described above is that the weather relevance rules 508 provide for further manipulation and data transformation with respect to the weather information 506 in order to determine more specifically how the weather information 506 applies to the particular type of aircraft 110 being flown and to the departure or destination airport. The weather notification processor 516 utilizes the weather information 506 in conjunction with applicable airport data 520 to calculate various weather components 624, particularly with respect to the airport wind category 622.

For example, the airport data 520 associated with the destination airport is entered into the flight computer prior to the flight and may be updated during flight as conditions change. The airport data 520 may include the active runway being used for landings. The runway number corresponds to a runway direction or alignment. Specifically, multiplying a runway number by a factor of 10 results in a compass heading. So runway 18 corresponds to a runway heading of 180 degrees, or south. Utilizing the runway alignment and the wind direction at the airport that is received as part of the weather content 502, the weather notification processor may calculate crosswind and headwind components 624 using known algorithms.

Specifically, subtracting the wind direction from the runway alignment results in the wind angle. Multiplying the wind speed by the sine of the wind angle results in the crosswind component of the wind at the airport for the applicable runway. Similarly, multiplying the wind speed by the cosine of the wind angle results in the headwind component of the wind over the applicable runway. Each type of aircraft has its own performance capabilities for a given wind component. The particular threshold 626 for the particular wind component may be established according to the aircraft 110 utilizing the weather relevance rules 508.

The thresholds 626 provide the weather notification processor 516 with a predetermined value to use for comparing with the corresponding current or forecasted value from the received weather content 502. For example, as seen in the weather relevance rules example 608, there are two threshold values listed for the crosswind component (CWC). The first threshold 626 is for a crosswind component that is greater than 20 knots and the second threshold 626 corresponds to a crosswind component that is greater than 30 knots. There may be more or fewer thresholds 626 for a given weather component 624. There are only two example thresholds 626 shown for the CWC, and only one for most weather components 624 of the weather relevance rules example 608 for clarity purposes. So if the weather notification processor 516 determines that the weather information 506 includes a report of a crosswind component of 25 knots, then the corresponding relevance code 304 can be selected from the row containing the CWC ">20" threshold and the column pertaining to the applicable target phase of flight 204.

The particular values that are stored for any given threshold 626 may be predetermined using any applicable or desired information. For example, a threshold 626 may be determined according to operational experience, engineering analysis, pilot or operating company preference, and/or aircraft capabilities. In this manner, the weather relevance rules 508 may vary from aircraft to aircraft or company to company. The thresholds 626 may be pre-set and protected so that they may only be set by authorized personnel, or may be at least partially customizable so that an aircrew may have access via a user interface to set one or more thresholds 626.

The relevance codes 304 represent the level of relevance of the particular weather component 624, with each letter associated with the level of relevance in the context of a particular flight segment along the flight route and/or one or more airports associated with that flight segment. As discussed above with respect to NOTAMs, according to various embodiments, the first letter of the relevance code 304 corresponds to the departure airport or other alternative departure airport, or to the departure segment of flight of the planned flight route. The second letter corresponds to an en route airport or other airport under ETOPS guidelines, or to the en route segment of flight of the planned flight route. The third letter corresponds to the alternate destination airports. The fourth letter corresponds to the destination airport or to the arrival segment of flight of the planned flight route. The letter itself identifies the level of relevance of the associated weather information. According to one embodiment, the letters may be "S" for "Significant," "L" for "Limited," "M" for "Minor," or "N" for "Non-relevant." It should again be appreciated that any number of letters, numbers, or symbols may be used as the relevance codes 304. For example, according to an alternative embodiment, the relevance codes 304 each contain three letters, corresponding to the departure, en route, and arrival flight segments, respectively. Similarly, the letters are not limited to "S," "L," "M," and "N." Rather, any quantity and type of relevance indicators can be used within the relevance codes 304.

An illustrative example will now be described to illustrate the data transformation from weather information 506 into applicable weather components 626, and further into an applicable notification 126. Assume that weather content 502 is received from a METAR that indicates a wind direction of 140 degrees that is blowing at 23 knots at an applicable airport. The airport data 520 indicates that the active runway is 07, which means that the runway direction is 070 degrees. The applicable formulas for calculating the HWC and CWC are as follows:

$$HWC=\cos(WA)*\text{speed}$$

$$CWC=\sin(WA)*\text{speed}$$

Utilizing these formulas, the HWC is determined to be 8 knots, with a CWC of 22 knots. Similarly, using the METAR data that the wind is gusting to 32 knots, the weather notification processor 516 can calculate a peak HWC of 11 knots and a peak CWC of 30 knots. Looking at the weather relevance rules example 608 of FIG. 7A, the weather notification processor 516 finds the weather component 624 corresponding to "CWC_GUST," which indicates the crosswind gust component. Finding the row corresponding to the threshold 626 that encompasses the calculated peak of 30 knots (only the threshold corresponding to ">25" is shown, although in practice, there may be multiple threshold values associated with the crosswind gust component), the weather notification processor 516 retrieves the relevance code 304 that intersects the column corresponding to cruise flight since the METAR was received during the cruise phase of flight.

With the weather information system 500 embodiment, the target phase of flight 204 corresponds to the current phase of flight in which the aircraft 110 is currently in when receiving the weather information 506. The letter of the resulting relevance code 304 corresponding to the flight segment of interest may be used to determine the significance of the weather information for notification purposes. In this example, the resulting relevance code 304 is "MMLL," which has been highlighted for illustrative purposes. Utilizing the weather relevance rules example 608 and the CWC of 22 knots during cruise flight (threshold 626 of ">20 knots"), the relevance code 304 is again "MMLL."

In determining the type of notification 126 to provide, the relevance code 304 is used in conjunction with a notification activation code 712 to trigger an appropriate DSL 128, similar to the notification of applicable NOTAMs described above. FIG. 7B illustrates a DSL activation example 702 that shows a partial chart of DSL activation rules. According to this example, there may be multiple DSL categories 704 having any number of DSL components 706. The manner in which the DSL activation codes are applied to the various aspects of the weather information 506 and corresponding relevance codes 304 is not germane to the various embodiments. The DSL concept encompasses not only assigning a level of relevance to a weather component to determine how to notify the applicable party, but also to confirm the relevance code 304 due to any number of variables that may alter a predetermined relevance.

As an example, according to the weather notification embodiments described herein, the weather is constantly changing. Of particular interest when determining the level of relevance is the timing of the weather information 506. Weather content regarding a destination airport that is received during cruise flight might indicate a significant level of relevance to the aircraft when landing. However, if the aircraft is not landing for another 8 hours, the weather at the destination airport might have changed, decreasing the previously significant level of relevance. To account for this dynamic element of the weather information and its corresponding timeliness, the weather notification processor 516 determines the proper notification activation code 712 corresponding to the weather information 506 and makes any relevance modifications prior to providing the corresponding notification 126.

The notification activation codes 712 are used to determine whether the relevance code is effective (E1), is effective if an E1 information source is not available (E2), should be downgraded one level (D), or should be changed to Minor relevance (U). To determine the proper notification activation code 712, the weather notification processor 516 may utilize various factors, including but not limited to, the weather content source, the time that the content was received, the applicable time in which the weather content is valid, and the estimated time until the aircraft 110 is within the applicable weather area. As seen in the DSL activation example 702, the DSL categories 704 include message validation in which the DSL components 706 correspond to weather message sources for airport and area weather. Depending on the source, how old the information is, and the period in which the information is valid, the relevance code 304 determined by the weather notification processor 516 may be deemed effective, or may be downgraded one or more levels. The DSL categories 704 of this example also includes time-based correlation, which provides instructions as to the activation code corresponding to a relevance code 304 according to an effective time period that is included within the weather content 502 when received. To illustrate these activation code concepts, two examples will now be discussed.

Returning to the previous example in which the weather content 502 is received from a METAR indicated a wind direction of 140 degrees blowing at 23 knots at an applicable airport, the resulting relevance code 304 was determined to be "MMLL." Looking at FIG. 7B, the notification activation code 712 corresponding to a METAR (source of the message in this example) is E2, which means it is effective if there is not information from an E1 source available. Assuming the aircraft is within 30 minutes of landing, the notification activation code 712 remains E2. The relevant digit is the fourth digit, "L," since the weather information 506 is pertinent to the destination airport. As seen in box 714, the "L" level of relevance correlates to a DSL of 2, which triggers the weather notification processor 516 to provide a visual and textual notification of the weather information 506.

According to a second illustrative example, assume a METAR/TAF is received during cruise flight indicating vertical visibilities of less than 500 feet at the destination airport, which is just more than an hour away. From FIG. 7A, the relevance code 304 of vertical visibilities less than 500 feet for cruise flight is significant as it relates to the destination airport (MLLS—highlighted for illustrative purposes). Because the remainder of the flight is greater than an hour, the content of the TAF carries higher weight than the METAR message. Even though the notification activation code 712 triggered by the TAF is E1, the weather content 502 includes the prefix "TEMPO" corresponding to an effective time period. Returning to FIG. 7B, the time-based correlation category 704 shows the prefix TEMPO downgrades the level of relevance of the forecasted ceiling from MLLS to MLLL. The "L" level of relevance again correlates to a DSL of 2, which triggers the weather notification processor 516 to provide a visual and textual notification of the weather information 506.

It should be noted that according to one embodiment, a downgrade associated with weather content 502 that is specific to a particular airport only downgrades the relevance letter of the relevance code 304 associated with that particular airport. For example, in the example above, the METAR information that is specific to the destination airport downgraded the level of relevance of the forecasted ceiling from MLLS to MLLL since the fourth letter is associated with the destination airport for which the METAR applies. However, according to another implementation, all downgrades could apply to letters of a relevance code 304 associated with alternate airports as well.

Figure 8:
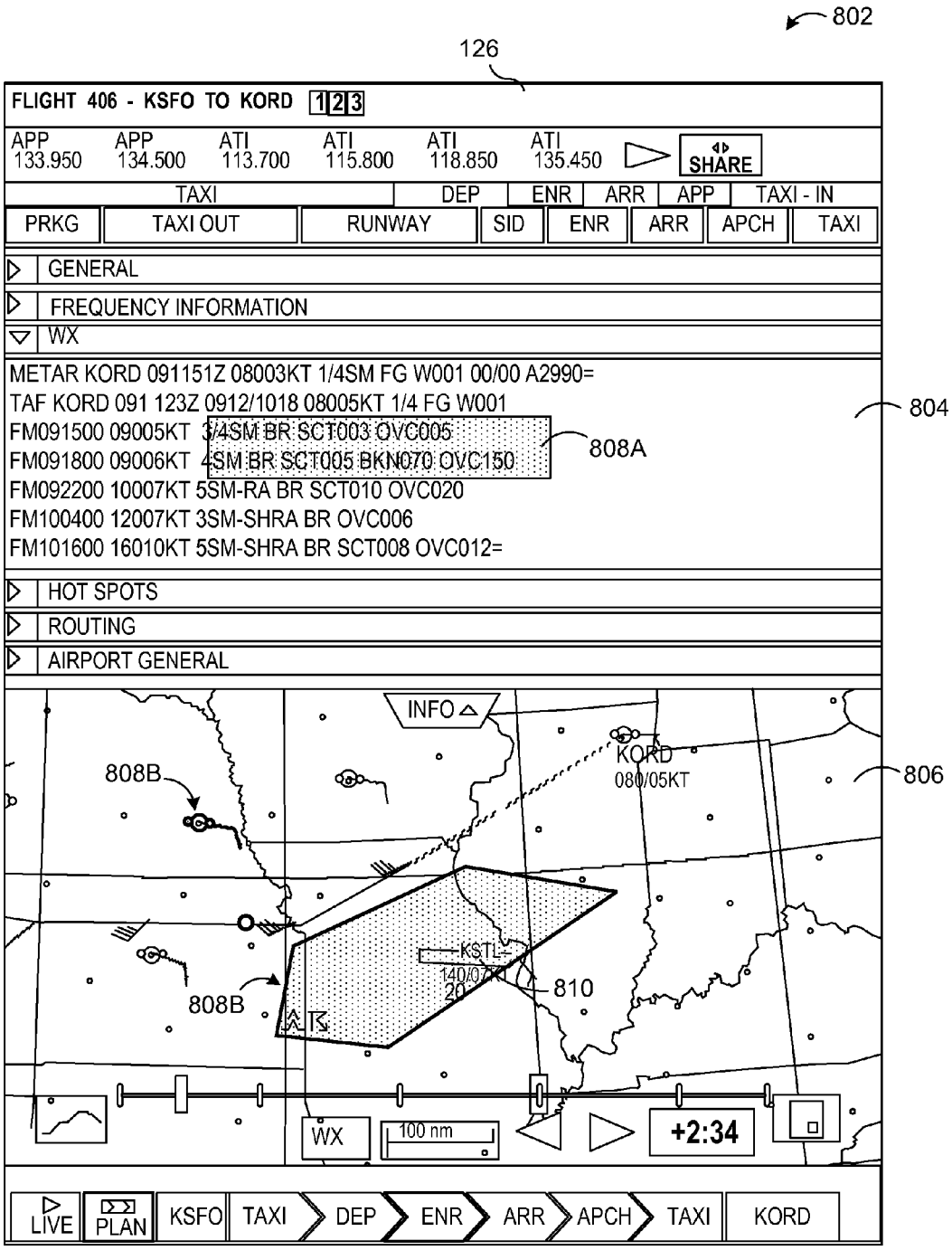
FIG. 8 is a screen diagram showing an illustrative textual and graphical weather notification according to one embodiment presented herein.

Turning now to FIG. 8, an illustrative example showing a screenshot 802 of a notification 126 according to one embodiment will be described. According to this example, the screenshot 802 shows a view of an electronic flight bag (EFB) that a pilot may utilize during the course of a flight. A typical EFB may provide the pilot with an interface for accessing a large quantity of data that may be applicable to any phase of the flight. According to one embodiment, the weather notification processor 516 provides the notification 126 to the EFB.

As seen in the example EFB screenshot 802, this notification 126 includes a textual portion 804 and a graphical portion 806. The graphical portion 806 includes a moving map that encompasses the destination airport 810. A feature of this notification 126 is that the textual portion 804 is dynamically coupled to the graphical portion 806 so that the applicable weather information 506 within the textual portion 804 is visually depicted on the graphical portion 806 and linked to the applicable text. For example, the weather information 808A may be highlighted in a particular color or using a particular font color such as red. The corresponding graphical representations 808B that depicts the weather information 808A may be highlighted or represented in a matching color, which is red in this example. Similarly, other weather information within the same textual portion 804 may be visually coupled to the graphical portion 806 using other colors.

According to one embodiment, each portion of the weather information in the textual portion 804 is automatically visually coupled to the corresponding graphical representations in the graphical portion 806 when the notification 126 is provided. According to another implementation, the pilot may select any portion of the textual weather information, which would then highlight the corresponding representation of the weather in the graphical portion 806. This dynamic coupling of the textual and graphical data allows pilots to visually process the information in the most efficient manner possible.

Figure 9:
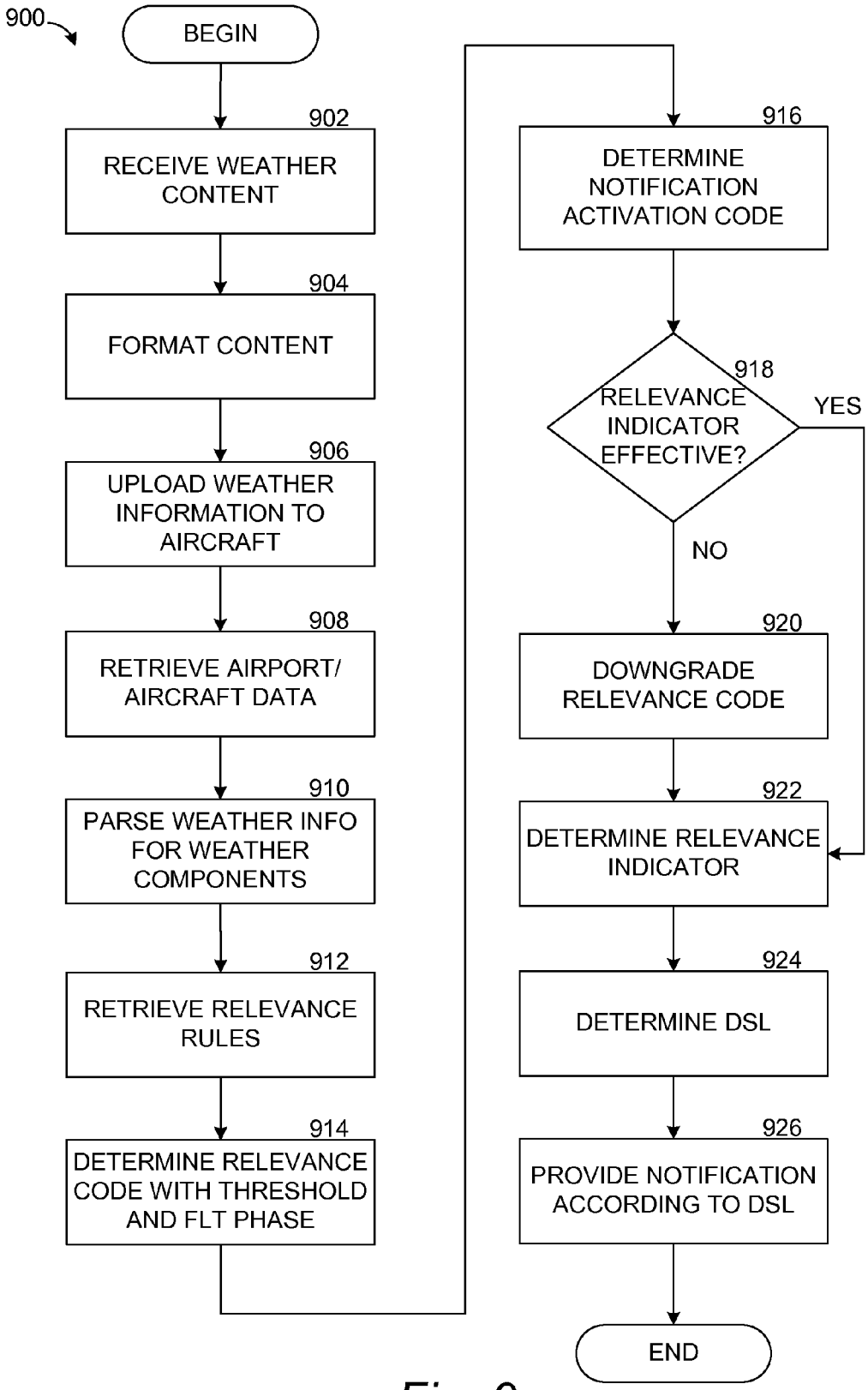
FIG. 9 is a process flow diagram illustrating a method for providing selective weather notifications according to various embodiments presented herein.

Turning now to FIG. 9, an illustrative routine 900 for providing selective notification of weather information 506 will now be described in detail. It should be appreciated that more or fewer operations may be performed than shown in the figures and described herein and that these operations may be performed in a different order than those described. The routine 900 begins at operation 902, where weather content 502 is received from one or more weather service providers or pilot reports. The weather content 502 may be formatted in an electronic format that can be easily parsed by the weather notification application 518 for applicable weather components 624 at operation 904.

The routine 900 continues to operation 906, where the weather information 506 is uploaded to the aircraft 110. It should be appreciated that the weather content 502 may not be formatted at all prior to storage and use by the weather notification processor 516, or it may be formatted by the weather notification processor 516 after upload to the aircraft 110. At operation 908, applicable airport data 520 and aircraft data 120 is retrieved by the weather notification processor 516. As described above, the airport data 520 may include applicable runway information such as the active runway heading, as well as any other information that may affect the priority or level of relevance of the weather information 506. The aircraft data 120 may include not only data relevant to the phase of flight processor for determining the current phase of flight, but also aircraft performance characteristics that are applicable to the levels of relevance associated with weather thresholds 626. It should be understood that according to various embodiments, the weather notification processor 516 may not retrieve aircraft data 120 and calculate thresholds and/or relevance codes 304 during flight operations, but rather the thresholds 626 and relevance codes 304 may be predetermined and set within the weather relevance rules 508 according to the aircraft performance characteristics or other aircraft data 120.

From operation 908, the routine 900 continues to operation 910, where the weather notification application 518 parses the weather information 506 for weather components 624, as well as performs any additional transformations of the data, such as converting wind direction and speed into applicable crosswind and headwind components utilizing the applicable runway characteristics. At operation 912, the weather notification application 518 retrieves the weather relevance rules 508 from the relevance rules database 114. At operation 914, the applicable relevance codes 304 are determined using the weather components 624, the applicable thresholds 626, and the target phase of flight 204, which is determined by the phase of flight processor 124.

From operation 914, the routine 900 continues to operation 916, where the weather notification application 518 determines the notification activation codes 712 that are associated with the weather content 502 and its source. The routine 900 continues to operation 918, where a determination is made as to whether or not the applicable relevance indicator is effective. If the relevance indicator is effective, the relevance code 304 remains the same and the routine 900 proceeds from operation 918 to operation 922 and continues as described below. However, if at operation 918, the weather notification application 518 determines from the notification activation code 712 that the relevance indicator is not effective, then the routine 900 continues to operation 920, where the relevance code 304 is downgraded, such as changing a "Significant" relevance indicator to a "Minor" relevance indicator.

From operation 920, the routine 900 continues to operation 922, where the relevance indicators are determined for each weather component 624. As previously discussed, these indicators may correspond to various flight segments and/or airports throughout the planned flight route and provide an indication as the level of relevance that the weather information 506 has to that flight segment or airport based on the current position of the aircraft 110. The applicable relevance indicators trigger a DSL 128 that instructs the weather notification application 518 as to the method of notification to be used when providing the weather information 506 to the pilot. After determining the DSLs 128 at operation 924, the routine 900 continues to operation 926, where the applicable notifications 126 are provided to the crew of the aircraft 110 according to the DSLs 128.

Figure 10:
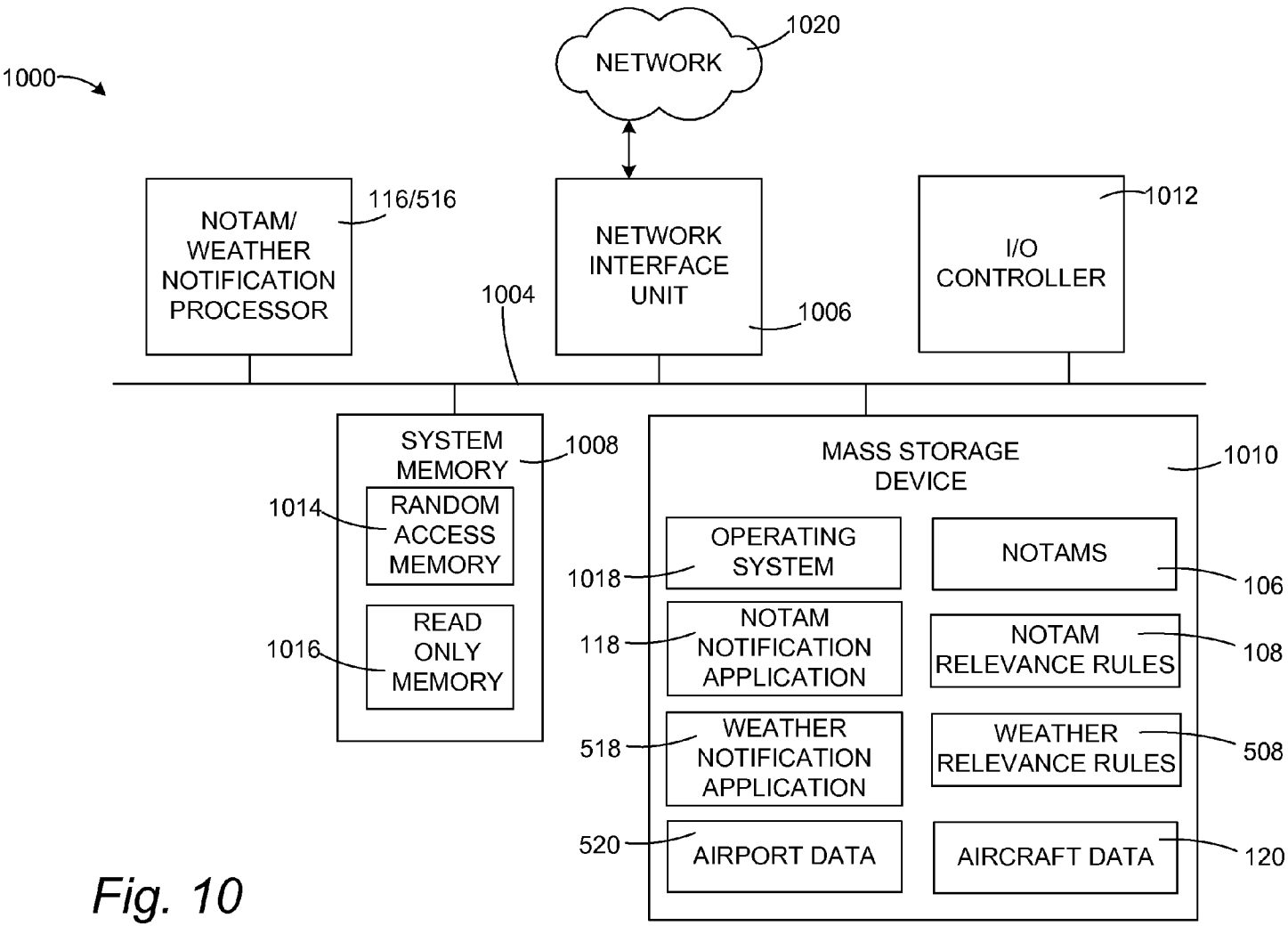
FIG. 10 is a computer architecture diagram showing an illustrative computer hardware and software architecture for a computing system capable of implementing the embodiments presented herein.

FIG. 10 shows an illustrative computer architecture for a computer 1000 capable of executing the software components described herein for selectively providing weather and NOTAM notifications. The computer architecture shown in FIG. 10 illustrates a conventional desktop, laptop computer, server computer, or any flight computer configured for use with an aircraft system and may be utilized to implement the computer 1000 and to execute any of the other software components described herein.

The computer architecture shown in FIG. 10 includes a NOTAM notification processor 116 and/or a weather notification processor 516, which may be one in the same. The computer architecture additionally includes a system memory 1008, including a random access memory 1014 (RAM) and a read-only memory (ROM) 1016, and a system bus 1004 that couples the memory to the processor 116/516. A basic input/output system (BIOS) containing the basic routines that help to transfer information between elements within the computer 1000, such as during startup, is stored in the ROM 1016. The computer 1000 further includes a mass storage device 1010 for storing an operating system 1018, application programs, and other program modules, which will be described in greater detail below. The mass storage device 1010 may include the centralized database 112 and/or the relevance rules database 114 described above.

The mass storage device 1010 is connected to the processor 116/516 through a mass storage controller (not shown) connected to the bus 1004. The mass storage device 1010 and its associated computer-readable media provide non-volatile storage for the computer 1000. Although the description of computer-readable media contained herein refers to a mass storage device, such as a hard disk or CD-ROM drive, it should be appreciated by those skilled in the art that computer-readable storage media can be any available computer storage media that can be accessed by the computer 1000.

By way of example, and not limitation, computer-readable storage media may include volatile and non-volatile, removable and non-removable media implemented in any method or technology for storage of information such as computer-readable instructions, data structures, program modules or other data. For example, computer-readable storage media includes, but is not limited to, RAM, ROM, EPROM, EEPROM, flash memory or other solid state memory technology, CD-ROM, digital versatile disks (DVD), HD-DVD, BLU-RAY, or other optical storage, magnetic cassettes, magnetic tape, magnetic disk storage or other magnetic storage devices, or any other medium which can be used to store the desired information and which can be accessed by the computer 1000. As used herein, the term computer-readable storage media does not encompass transitory signals.

According to various embodiments, the computer 1000 may operate in a networked environment using logical connections to remote computers through a network such as the network 1020. The computer 1000 may connect to the network 1020 through a network interface unit 1006 connected to the bus 1004. It should be appreciated that the network interface unit 1006 may also be utilized to connect to other types of networks and remote computer systems. The computer 1000 may also include an input/output controller 1012 for receiving and processing input from a number of other devices, including a keyboard, mouse, or electronic stylus (not shown in FIG. 10). Similarly, an input/output controller may provide output to a display screen, a printer, or other type of output device (also not shown in FIG. 10).

As mentioned briefly above, a number of program modules and data files may be stored in the mass storage device 1010 and RAM 1014 of the computer 1000, including an operating system 1018 suitable for controlling the operation of a networked desktop, laptop, server, or other flight computer. The mass storage device 1010 and RAM 1014 may also store one or more program modules. In particular, the mass storage device 1010 and the RAM 1014 may store the NOTAMs 106, the NOTAM relevance rules 108, the notification application 118, the weather relevance rules 508, the weather notification application 518, the aircraft data 120, the airport data 520, and any corresponding modules described above. The mass storage device 1010 and RAM 1014 may also store other program modules and data.

In general, software applications or modules may, when loaded into the processor 116/516 and executed, transform the processor 116/516 and the overall computer 1000 from a general-purpose computing system into a special-purpose computing system customized to perform the functionality presented herein. The processor 116/516 may be constructed from any number of transistors or other discrete circuit elements, which may individually or collectively assume any number of states. More specifically, the processor 116/516 may operate as one or more finite-state machines, in response to executable instructions contained within the software or modules. These computer-executable instructions may transform the processor 116/516 by specifying how the processor 116/516 transitions between states, thereby physically transforming the transistors or other discrete hardware elements constituting the processor 116/516.

Encoding the software or modules onto a mass storage device may also transform the physical structure of the mass storage device or associated computer-readable storage media. The specific transformation of physical structure may depend on various factors, in different implementations of this description. Examples of such factors may include, but are not limited to: the technology used to implement the computer-readable storage media, whether the computer-readable storage media are characterized as primary or secondary storage, and the like. For example, if the computer-readable storage media is implemented as semiconductor-based memory, the software or modules may transform the physical state of the semiconductor memory, when the software is encoded therein. For example, the software may transform the states of transistors, capacitors, or other discrete circuit elements constituting the semiconductor memory.

As another example, the computer-readable storage media may be implemented using magnetic or optical technology. In such implementations, the software or modules may transform the physical state of magnetic or optical media, when the software is encoded therein. These transformations may include altering the magnetic characteristics of particular locations within given magnetic media. These transformations may also include altering the physical features or characteristics of particular locations within given optical media, to change the optical characteristics of those locations. Other transformations of physical media are possible without departing from the scope and spirit of the present description, with the foregoing examples provided only to facilitate this discussion.

Based on the foregoing, it should be appreciated that technologies for selectively providing NOTAM notifications and weather notifications have been presented herein. Although the subject matter presented herein has been described in language specific to computer structural features, methodological acts, and computer readable media, it is to be understood that the invention defined in the appended claims is not necessarily limited to the specific features, acts, or media described herein. Rather, the specific features, acts and storage mediums are disclosed as example forms of implementing the claims.

The subject matter described above is provided by way of illustration only and should not be construed as limiting. Various modifications and changes may be made to the subject matter described herein without following the example embodiments and applications illustrated and described, and without departing from the true spirit and scope of the present disclosure, which is set forth in the following claims.

What is claimed is:

1. A computer-implemented method for selectively providing weather notifications to a crew of an aircraft, the computer-implemented method comprising:

receiving weather information and parsing the weather information into weather components;

associating a threshold with each weather component;

determining a relevance code for each of a plurality of predetermined phases of flight according to the threshold of each weather component, wherein weather components during any particular phase of flight have different relevance codes;

determining a target phase of flight of the plurality of predetermined phases of flight associated with the aircraft;

determining a relevance for each weather component based on the corresponding relevance code during the target phase of flight;

and providing a notification associated with the weather information according to the relevance of at least one weather component for the target phase of flight.

2. The computer-implemented method of claim 1, wherein the target phase of flight comprises a current phase of flight, and wherein determining the current phase of flight associated with the aircraft comprises retrieving real-time aircraft data collected from one or more aircraft sensors and utilizing the real-time aircraft data to determine the current phase of flight.

3. The computer-implemented method of claim 1, wherein the relevance code comprises a multi-letter code, each letter associated with a flight segment of a planned flight route.

4. The computer-implemented method of claim 3, further comprising:

determining a notification activation code for the relevance code; and modifying the relevance code according to the notification activation code.

5. The computer-implemented method of claim 4, wherein the notification activation code comprises an indicator that the relevance code is effective or an indicator that the relevance code is not effective, wherein if the notification activation code comprises the indicator that the corresponding relevance code is not effective, then modifying the relevance code according to the notification activation code comprises downgrading the relevance code prior to determining the one or more types of notifications to provide.

6. The computer-implemented method of claim 5, further comprising determining a display and signaling level code corresponding to the relevance code, wherein providing the notification associated with the weather information according to the level of relevance for the target phase of flight comprises providing the notification associated with the weather information according to the display and signaling level code.

7. The computer-implemented method of claim 6, wherein the notification comprises a textual portion and a graphical portion, wherein at least a portion of the weather information is presented as text in the textual portion and concurrently presented as a graphical representation in the graphical portion, and wherein the graphical representation is visibly identifiable as representing the text.

8. The computer-implemented method of claim 1, further comprising utilizing airport data corresponding to a destination airport to transform the weather information into at least one value corresponding to the weather component associated with the destination airport, wherein determining the relevance for the weather information according to the target phase of flight comprises utilizing the at least one value to select the threshold associated with the weather component and to determine the relevance code associated with the target phase of flight according to the threshold of the weather component, and wherein providing the notification associated with the weather information according to the relevance for the target phase of flight comprises providing the notification associated with the weather information according to the relevance code for the target phase of flight.

9. A weather information system, comprising:

a weather notification processor;

a memory communicatively coupled to the weather notification processor; and a weather notification application (i) which executes in the weather notification processor and (ii) which, when executed by the weather notification processor, causes the weather notification computer system to provide relevant weather information to a crew of an aircraft according to a target phase of flight by receiving weather information and parsing the weather information into weather components;

associating a threshold with each weather component;

determining a relevance code for each of a plurality of predetermined phases of flight according to the threshold of each weather component, wherein weather components during any particular phase of flight have different relevance codes;

determining a target phase of flight of the plurality of predetermined phases of flight associated with the aircraft;

determining a relevance for each weather component based on the corresponding relevance code during the target phase of flight; and providing a notification associated with the weather information according to the relevance of at least one weather component for the target phase of flight.

10. The weather information system of claim 9, wherein retrieving the relevance code associated with the weather component of the weather information comprises retrieving the relevance code associated with the target phase of flight according to a threshold of the weather component, the threshold selected according to the weather information, and wherein the relevance code comprises a multi-letter code, each letter associated with a flight segment of a planned flight route.

11. The weather information system of claim 10, wherein the weather notification application, when executed by the weather notification processor, further causes the weather notification computer system to provide relevant weather information to the crew of the aircraft according to the target phase of flight by determining a notification activation code for the relevance code;

modifying the relevance code according to the notification activation code, wherein providing the notification associated with the weather information according to the level of relevance for the target phase of flight comprises providing the notification associated with the relevance code after modifying the relevance code according to the notification activation code.

12. The weather information system of claim 11, wherein the notification activation code comprises an indicator that the relevance code is effective or an indicator that the relevance code is not effective, wherein if the notification activation code comprises the indicator that the corresponding relevance code is not effective, then modifying the relevance code according to the notification activation code comprises downgrading the relevance code prior to determining the one or more types of notifications to provide.

13. The weather information system of claim 12, wherein the weather notification application, when executed by the weather notification processor, further causes the weather notification computer system to provide relevant weather information to the crew of the aircraft according to the target phase of flight by determining a display and signaling level code corresponding to the relevance code, wherein providing the notification associated with the weather information according to the level of relevance for the target phase of flight comprises providing the notification associated with the weather information according to the display and signaling level code.

14. A non-transitory computer-readable storage medium having computer-executable instructions stored thereupon which, when executed by a computer, cause the computer to:

receive weather information and parsing the weather information into weather components;

associating a threshold with each weather component;

determining a relevance code for each of a plurality of predetermined phases of flight according to the threshold of each weather component, wherein weather components during any particular phase of flight have different relevance codes;

determine a target phase of flight of the plurality of predetermined phases of flight associated with an aircraft;

determining a relevance for each weather component based on the corresponding relevance code and at least one performance criteria associated with the aircraft during the target phase of flight;

determine a notification method according to the relevance of weather information; and provide a notification associated with the weather information according to the notification method.

15. The non-transitory computer-readable storage medium of claim 14, wherein causing the computer to retrieve the relevance code corresponding to the weather component of the weather information according to the target phase of flight comprises causing the computer to retrieve the relevance code associated with the target phase of flight according to the threshold of the weather component, the threshold selected according to the weather information, and wherein the relevance code comprises a multi-letter code, each letter associated with a flight segment of a planned flight.

16. The non-transitory computer-readable storage medium of claim 15, wherein causing the computer to determine the notification method according to the relevance comprises causing the computer to identify a notification activation code associated with a time component of a source of the weather information, utilize the notification activation code to update the relevance code if necessary.

* * * * *